United States Patent [19]

Phillips

[11] 4,080,087

[45] Mar. 21, 1978

[54] RAILLESS WALKWAY FOR THE VISUALLY HANDICAPPED

[75] Inventor: Curtis Alfred Phillips, Los Angeles, Calif.

[73] Assignees: Curtis Alfred Phillips; Linda Louise Phillips, both of Los Angeles, Calif.

[21] Appl. No.: 794,262

[22] Filed: May 5, 1977

[51] Int. Cl.[2] ..... E01C 15/00

[52] U.S. Cl. ..... 404/72; 404/9; 404/42; 35/38; 116/DIG. 17

[58] Field of Search ..... 404/15, 9, 6, 72, 17, 404/42; 35/38, 35 A, DIG. 2; 116/114 G, DIG. 17

[56] References Cited

U.S. PATENT DOCUMENTS

| | | | |
|---|---|---|---|
| 1,647,861 | 11/1927 | Furey | 404/15 |
| 1,698,594 | 1/1929 | Hoff | 404/15 |
| 2,574,090 | 11/1951 | Dofsen | 404/15 |
| 3,363,339 | 1/1968 | Place | 35/38 |
| 3,417,676 | 12/1968 | Lenoble | 404/9 |

*Primary Examiner*—Nile C. Byers

*Attorney, Agent, or Firm*—Spensley, Horn, & Lubitz

[57] ABSTRACT

A railless walkway for blind and visually handicapped persons is constructed using foot plates fastened to the ground. By feeling humps made into the foot plates, the blind are guided along walkways without the use of rails or canes. Variations in the shape and/or number of humps provide additional information as to walkway directions, such as turns, steps, stairs, rest areas, and the like. The foot plates are fabricated out of permanent, solid material and are either incorporated in the walkway during its construction or are fastened permanently to the walkway if added later.

13 Claims, 7 Drawing Figures

Fig. 1
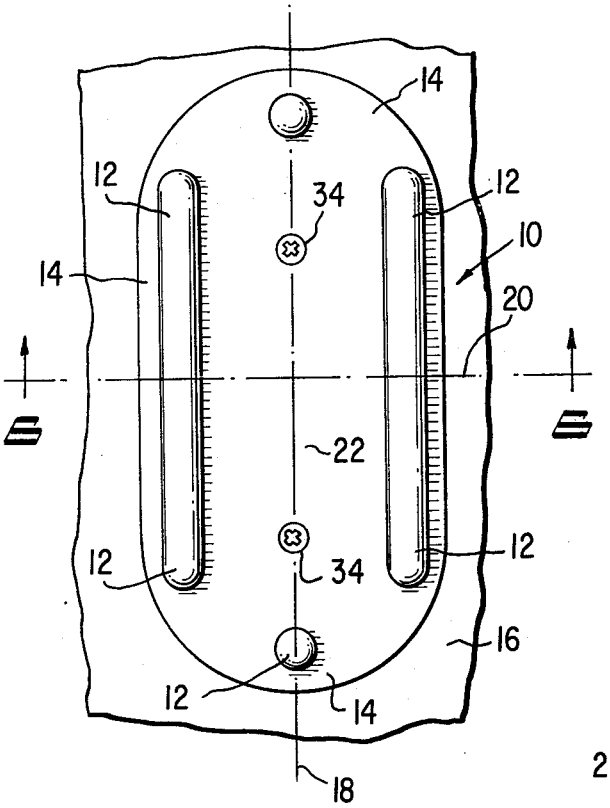
Fig. 2
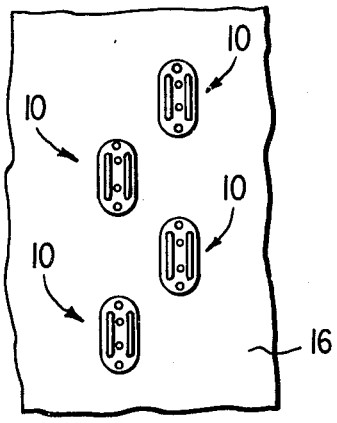
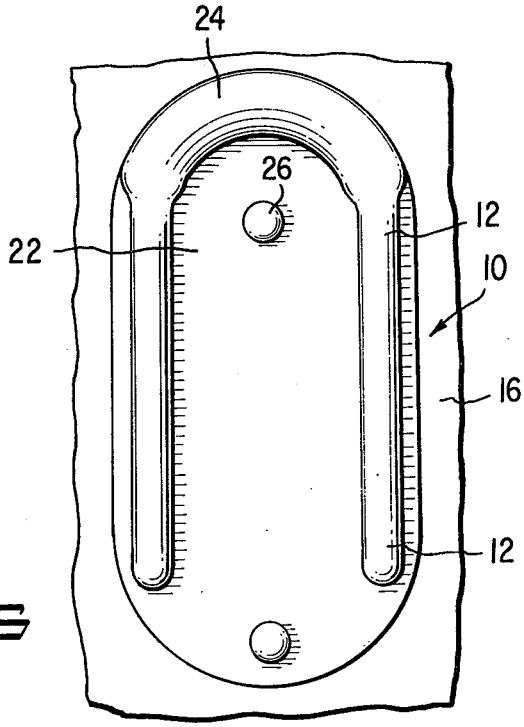
Fig. 3
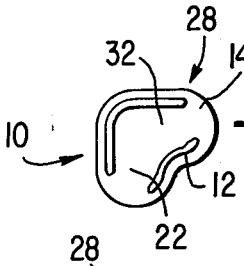
Fig. 4
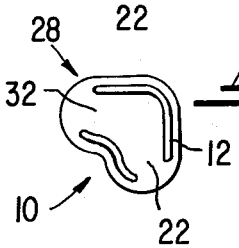
Fig. 5
Fig. 6
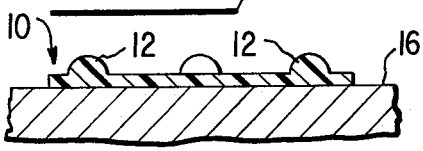
Fig. 7
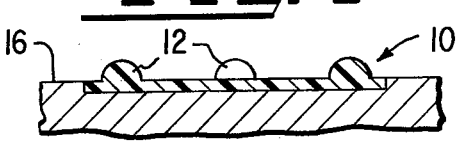

RAILLESS WALKWAY FOR THE VISUALLY HANDICAPPED

BACKGROUND OF THE INVENTION

1. Field of the Invention

The present invention relates to the field of apparatus used to aid the blind and visually handicapped and in particular, relates to devices used to guide the visually handicapped along walkways and through passages.

2. Description of the Prior Art

Types of devices previously used by the blind and visually handicapped to aid their movement along walkways, halls and paths have typically been limited to items such as canes, sticks and specially trained dogs. Each of these aids are subject to significant limitations. For example, the use of a cane or a stick aids the individual in extending his tactile feel beyond the range of his natural extremities. Thus, the the walkway is that which is communicated through the cane by collision between the end of the cane approximately six to eight feet distant from the user's hand. Clearly, the cane may not collide with all obstacles and provides a limited amount of information to the user. Thus, the blind or visually handicapped person must make numerous deductions and assumptions based upon partial information provided by the tactile extension of the cane or walking stick together with information which he is able to accumulate by hearing or by assumption as to the general context in which he believes himself to be. In situations where such a person is in a strange area or has defective hearing or in which hearing is difficult, the significance of information provided by the cane is even more limited. The use of seeing-eye dogs permits the user to substitute the eyes and behavorial training of the animal for his own. Thus, the information provided by the pull of the dog's harness to the user's hand is similarly limited by the intelligence of the animal, and the degree of training and behavorial modification which has been imprinted upon the animal. Clearly, in situations in which the animal has not been trained, the animal may be unable to provide an appropriate response. Moreover, the use of animals is expensive and sometimes inconvenient. Many seeing individuals who are nevertheless visually handicapped, cannot justify use of such an aid.

Therefore, what is needed is an inexpensive device which can be used by the blind and visually handicapped to provide guidance along paths, walkways, hallways, stairs and the like, even in cases where such areas may be totally unfamiliar to the handicapped person. The present invention overcomes each of the prior art disadvantages and provides an appropriate solution.

BRIEF SUMMARY OF THE INVENTION

The present invention is a walkway for visually handicapped persons which provides tactile information by the use of foot plates attached to a walkway surface. The foot plate comprises a solid plate having a plurality of humps to provide such tactile information. For example, the walkway may include foot plates having a first type of hump used to indicate the directional information. The walkway may also include foot plates which have a second type of hump to indicate curbs, steps and changes in the level of the walkway surface and like information. The plurality of humps may be configured to circumscribe the person's shoe. The foot plate may be shaped like a foot imprint. The humps may be configured to have a mirror symmetry about the plane perpendicular to the long axis of the foot plate whereby the walkway is bidirectionally symmetrical.

The present invention also includes the method of using the above described device in a walkway. For example, the present invention includes a method for providing parambulatory guidance to visually handicapped persons which comprises the step of disposing a plurality of foot plates on a walking surface in a configuration simulating normal human walking. Each foot plate has a plurality of humps disposed on a circumferential region of the foot plate to circumscribe a step region where the person is to place his foot. The foot plate may further include at least one hump disposed within the step region to provide further parambulatory information such as information pertaining to direction, distance, hazard, obstacle, change of level, presence of facilities and like information. These and other advantages of the present invention, together with its various embodiments, may be better understood by viewing the following figures.

BRIEF DESCRIPTION OF THE FIGURES

FIG. 1 is a plan view of a typical foot plate showing the plurality of humps around the circumferential region of the foot plate.

FIG. 2 is a plan view of a series of foot plates arranged and configured so as to simulate normal human walking.

FIG. 3 is a plan view of another embodiment of the present invention wherein a further hump is disposed on the foot plate to provide additional perambulatory information.

FIG. 4 is a top view of another embodiment of the present invention wherein the foot plate shape is altered to indicate directional information, such as a right turn.

FIG. 5 is a plan view of the embodiment show in FIG. 4 which is oriented and configured to indicate a left turn.

FIG. 6 is a fragmentary cross sectional view of the foot plate of FIG. 1 showing the integral construction of the hump with the foot plate.

FIG. 7 is a fragmentary cross sectional view of the foot plate of FIG. 1 showing the embodiment wherein the foot plate is embedded or merged into the surface of the walkway.

DETAILED DESCRIPTION OF THE PREFERRED EMBODIMENTS

The present invention is an apparatus and method for indicating walkway directions to blind and visually handicapped persons without the use of rails, canes or seeing-eye dogs. The present invention includes the method of attaching foot plates to the ground or walkway, wherein these foot plates are used to provide perambulatory information to the user. The blind person literally "feels" the way to go. Protuberances, humps or protrusions are provided around the periphery of the foot plate to allow for an easy determination of the correct direction in which the mover is to move. Special perambulatory information or walkway features may be indicated by varying the shape of the foot plate and the shape and/or the number of humps provided on the plate. These humps may indicate such perambulatory information such as direction, turns, steps, stairs, curbs, facilities, obstacles, change of level and the like such as rest areas or benches. The foot plate may be fabricated out of any durable material appropriate for the intended use such as conventional weather resistant materials typically used as highway markers. The humps may or may not be fabricated out of the same material and may or may not be integral with the foot plate. In any case, the humps may be permanently fastened to or formed with the foot plate by an appropriate means. The foot plate is appropriately attached to the walkway such as by riveting, nailing, epoxying, or may be built directly into the walkway during its construction such that the general plane of the foot plate is flush with the surface of the walkway. It may be possible that the material of the walkway itself may be used for formation of the humps and the foot plate and humps may be integral with the walkway. These and other embodiments of the present invention are best understood by referring to the following figures.

FIG. 1 shows one embodiment of the present invention wherein a foot plate 10 provided with a plurality of humps or protrusions 12 provided around the periphery or circumferential region 14 of foot plate 10. In the embodiment illustrated, two parallel humps or ridges are shown. As shown in FIG. 1, foot plate 10 may be mounted on or in walkway 16. Typically, walkway 16 will be concrete, linoleum or wood flooring. In the embodiment illustrated in FIG. 1, foot plate 10 is shown as having a long axis 18 and a perpendicular or short axis 20. The shape and size of foot plate 10 is approximately the same as a human foot or shoe except that in the preferred embodiment, foot plate 10 possesses mirror symmetry about axis 20. Thus, the top plan view of foot plate 10 may be suggestive of the cross section of a symmetrical peanut or may be oblong. Thus, foot plate 10 is entirely and fully bidirectional and may be used by the visually handicapped person as a guiding walkway regardless of direction. Humps 12 are shown disposed on foot plate 10 within circumferential region 14. Typically, foot plate 10 is designed to be somewhat oversized such that the shoe or foot of the user will fit within a step region 22 which is at least partially circumscribed by the plurality of humps 12. Thus, the user will be able to approximately center his foot or shoe within step region 22 by sensing one of the plurality of humps 12 under foot when the foot or shoe is misaligned. As discussed above, humps 12 may be integral with foot plate 10 as in a solid plastic casting, molding or metallic casting or stamping or may be separate elements which have been affixed by conventional means to a metal, plastic, wood or other type composition foot plate 10.

Thus, the blind or visually handicapped person literally feels his way along the path by walking on consecutive foot plates 10 which have been arranged or configured as shown in FIG. 2 to simulate the normal human walk. By natural movement, the visually handicapped person will be able to place his foot in the approximate region of the next step. Should the path curve, the curve can be anticipated by small displacements of the next successive step. The extent of the foot plate is large enough that it will be easily detected by the user even though the foot plate may be intentionally displaced by small distance from the next expected position. Clearly, the size of the foot plate, the number of humps 12 disposed thereon and the separation, arrangement, configuration of a plurality of foot plates 10 as shown in FIG. 2 is a matter of design choice which can best be determined according to each application.

Perambulatory information useful to the user pertaining to features connected with the walkway may be provided by the use of additional humps or specially shaped humps and foot plates as shown in FIGS. 3, 4 and 5. For example, FIG. 3 shows one embodiment wherein a specially shaped hump 24 is provided at one end of foot plate 10. Although the coding and the information provided by such special hump 24 is a matter of arbitrary choice, it is contemplated that the hump illustrated in FIG. 3 may be used to signal to the user that the user has reached a curb boundary. A hump 26 set within the step region 22 and bracketed by the plurality of humps 12 may further indicate in conjunction with hump 24 or alone that the step indicates an ascending stairway. Similar enlarged humps, such as humps 24 disposed on the left or right side of one end of foot plate 10 may likewise indicate that a left or right turn is expected.

FIGS. 4 and 5 illustrate another embodiment wherein the shape of the foot plate may be altered to provide perambulatory information to the user. For example, FIG. 4 shows a curved foot plate having a right angle bend at one end of foot plate 10. For example, foot plate 10 may be bent and extended to form a right hand extension 28 similarly having a plurality of circumscribing humps 12 disposed in a circumferential region 14 of such a modified foot plate 10. Thus, the user may place his foot within step region 22 and be signaled by special hump 30 that a turn was indicated. A slight movement of the foot would indicate that the foot plate was extended to the right and that the foot should be moved at approximately a 90° angle to be placed within a secondary step region 32. Similarly, the same foot plate may be oppositely oriented as shown in FIG. 5 to indicate that a left turn in appropriate. Clearly, the variety of ways in which circumferential or special humps may be arranged and configured to provide perambulatory information to the user is unlimited and subject to a large number of combinations. It is expected that such foot plates will find the greatest application and use where the number of visually handicapped people is large, such as convalescent homes, hospitals, clinics or special recreational parks adapted for use by the visually handicapped.

The manner in which foot plates 10 might be affixed to walkway 16 are shown by way of example in FIGS. 6 and 7. FIG. 6 is a cross section through line 6—6 of FIG. 1 (axis 20) and shows a walkway 16 which has been retrofitted with a foot plate 10 by epoxying the lower surface of foot plate 10 to the upper surface of walkway 16. Conventional epoxies may be used, typically such epoxies as are used to affix plastic markers to asphalt or concrete road ways. As shown in FIG. 1, foot plate 10 may also be provided with holes 34 through which a nail, screw or rivet might be suitably disposed.

FIG. 7 illustrates another embodiment of the present invention wherein a walkway 16 has been specifically modified or adapted either by retrofitting or during initial construction such that foot plate 10 is merged within the surface of walkway 16. Thus, the upper surface of foot plate 10 is substantially flush with the upper surface of walkway 16 leaving humps 12 as the only portion of the device extending from the surface of walkway 16.

Many other modifications and alterations may be made in the present invention by those with ordinary skill in the art without departing from the spirit and scope of the present invention. For example, foot plate 10 may be eliminated and a plurality of humps 12 may be directly placed upon walkway 16 as taught by the present invention. Thus, this would include the embodiment where humps 12 would be integrally formed from the same material which forms walkway 16. It is to be contemplated that floor tiles or linoleum blocks may be fabricated as integral units having such protuberances, or that such humps may simply be nailed down to a wood, linoleum or concrete walkway. Further, the humps have been shown as cylinder-like projections, but it is also to be contemplated that the humps may be of any geometrical shape well known to the art such as a greater plurality of circumscribing hemispheres, triangles, blocks and posts. Thus, it is contemplated that in some embodiments, a hump having a generally wedge shape might be desired. In such a case, the wedge shape would have two surfaces, one having a steep slope and one having a gentle slope. The steep slopes may then be oriented towards the step region of the foot plate. The user would then be able to sense if he made contact with the inner or outer surface of such wedges and appropriately place his foot in the desired area. Such alterations and modifications are merely examples and illustrations as to how the present invention might be further embodied and are not intended to restrict or limit its scope.

I claim:

1. A walkway to aid a visually handicapped person providing tactile information by the use of foot plates attached to a walkway surface, said foot plates comprising solid plates having a plurality of humps to provide said inforamtion.

2. The walkway claim 1 wherein said foot plate has a first type of hump used to indicate directional information.

3. The walkway of claim 1 wherein said foot plate has a second type of hump used to indicate curbs, steps and changes in the level of said walkway surface.

4. The walkway of claim 1 wherein said foot plate is fastened to the walkway surface by indentation into the said walkway surface.

5. The walkway of claim 1 wherein at least one of said humps is integral with said foot plate.

6. The walkway of claim 1 wherein said foot plate is shaped like a foot imprint with a long and short axis, and wherein said plurality of humps are configured to at least partially circumscribe said person's shoe, said humps configured to have mirror symmetry about a plane perpendicular to said long axis of said foot plate whereby said walkway is bidirectionally symmetrical.

7. A device for the aid of a visually handicapped person comprising:

a foot plate; and a plurality of humps disposed on said foot plate to at least partially circumscribe said person's foot when placed on said foot plate whereby perambulatory guidance is provided to said person.

8. The device of claim 7 further comprising at least one hump to indicate specific information to said person whereby said person may be provided with information such as information pertaining to obstacles, distances, direction, facilities, change of level and potential hazards.

9. A method for providing perambulatory guidance to visually handicapped persons comprising the step of disposing a plurality of foot plates on a walking surface in a configuration simulating normal human walking, each said foot plate having a plurality of humps disposed on a circumferential region of said person's foot is to be placed.

10. The method of claim 9 wherein said foot plate further includes at least one hump disposed within said step region to provide further perambulatory information such as information pertaining to direction, distance, hazard, obstacle, change of level, and presence of facility.

11. The method of claim 9 wherein said foot plate further includes at least one hump, having a distinct configuration from said plurality of humps.

12. The method of claim 11 wherein said distinct configuration is one of shape of said at least one hump.

13. The method of claim 11 wherein said distinct configuration is one of position of said at least one hump with respect to said plurality of humps.

* * * * *